United States Patent [19]

Dumas

[11] 4,070,016

[45] Jan. 24, 1978

[54] NON-MECHANICAL LURE FOR DOG RACING

[76] Inventor: Bruce G. Dumas, Box 86, East Derry, N.H. 03041

[21] Appl. No.: 679,978

[22] Filed: Apr. 26, 1976

[51] Int. Cl.[2] ..... A63K 1/02

[52] U.S. Cl. ..... 272/4

[58] Field of Search ..... 272/4, 5; 340/332, 321, 340/331, 309.1, 309.3, 309.4, 309.5, 309.6; 35/29 R, 29 B; 58/152 E, 152 F; 40/106.52

[56] References Cited

U.S. PATENT DOCUMENTS

| | | | |
|---|---|---|---|
| 917,587 | 4/1909 | Good | 272/4 UX |
| 1,330,404 | 2/1920 | Sommer | 272/4 UX |
| 1,602,499 | 10/1926 | Meinecke | 272/4 |
| 1,787,631 | 1/1931 | Kitzmiller | 272/4 |
| 2,025,356 | 12/1935 | Neal | 40/106.52 |
| 2,457,968 | 1/1949 | Allen et al. | 272/4 UX |

FOREIGN PATENT DOCUMENTS

| | | | |
|---|---|---|---|
| 651,564 | 10/1928 | France | 272/4 |
| 611,172 | 6/1926 | France | 40/106.52 |
| 623,547 | 5/1949 | United Kingdom | 272/4 |

*Primary Examiner*—William H. Grieb
*Assistant Examiner*—Arnold W. Kramer
*Attorney, Agent, or Firm*—Pearson & Pearson

[57] ABSTRACT

To avoid the ever present danger of greyhounds inadvertently running in the wrong direction around a track and colliding with the conventional mechanical rabbit lure, advantage is taken of the dogs following sight rather than scent, to provide an advancing lure in the form of a series of groups of about five exposed light bulbs cantilevered over the track out of the path of the dogs and individually and successively energized as an advancing elongated strip of light. The bulbs may be staggered, or of different heights to increase the simulation of a rabbit.

4 Claims, 4 Drawing Figures

2
2
31
37
38
39
30
58
36
71
59
57
51
56
62
34
35
71
33
32

36
71
37
38
51
67
71
46
55
52
53
46
47
54
68
46
48
48
41
36
48
42
43
66
44
66
44
31
66
44
45
45
45

47
71
55
51
46
41
48
48
36
44
66
31
45

53
54
42
37
55
51
65
47
38
52
31
30
62
36
43
58
47
41
57
39
56
63
64
59
61

NON-MECHANICAL LURE FOR DOG RACING

BACKGROUND OF THE INVENTION

It has long been the custom in dog tracks to provide a mechanical rabbit lure, carried on the end of an arm extending over the track and in the path of the dogs, the lure being advanced by an electric motor travelling on a track such as the inner periphery fence. Such devices are disclosed in U.S. Pat. No. 611,876 to Walsh of Oct. 4, 1898, U.S. Pat. No. 1,647,067 to Wilson of Oct. 25, 1927, U.S. Pat. No. 1,703,496 to Naud of FEB. 26, 1929, U.S. Pat. No. 1,728,576 to Schem of Sept. 17,1929, U.S. Pat. No. 1,733,069 to Naud of Oct. 22, 1929, U.S. Pat. No. 1,850,048 to Ballew of Mar. 15, 1932 and U.S. Pat. No. 2,430,403 to Lemire of Nov. 4, 1947.

It should be noted that the danger of the dogs being hurt by colliding with mechanical lures when mistakenly running the wrong way, or when overtaking the lure at the end of a race is pointed out in the above patent to Schem, U.S. Pat. No. 1,728,576. In the Lemire U.S. Pat. No. 2,430,403 the lure support rod is arranged to yield upon contact with a dog for the same reasons.

A non-mechanical lure for dog tracks is disclosed in U.S. Pat. No. 1,602,499 to Meinecke of Oct. 12, 1926, wherein a motion picture projector on a revolving turret in the centre of a track projects a picture of a rabbit on the inside wall of an outer periphery fence around the track. A series of successively illuminated pictures of a rabbit mounted around the outside wall of a race course is disclosed in French Patent 651,564 to Shea et al of Oct. 9, 1928. A series of successively illuminated single bulbs set ten yards apart each in a box with a transparent cover is disclosed in U.S. Pat. No. 2,457,968 to Allen of Jan. 4, 1949, the series being within the inclosure of the inside fence of the track.

SUMMARY OF THE INVENTION

In this invention, as in the Meinecke patent above, light is used as the lure for the dogs so that there is no mechanical lure, or lure rod, upon which the dogs can be hurt in backtracking, or in overtaking the lure. However, instead of relying on a series of illuminated pictures of a rabbit or requiring a motion picture screen the full length of the outside perimeter of a dog track, a tower and a costly projector, in this invention a series of spaced apart groups of exposed light bulbs are mounted around the inside periphery of the track, above the level of the inner portion thereof, preferably on modular, portable, cantilevered upstanding fence-like sections. An endless belt switch means, or similar commercially available circuit control is provided to individually and successively illuminate and extinguish the exposed lamps in groups of five, all around the track, and above the level of the inner portion of the track to serve as a visible, advancing lure to the dogs. Thus the system can be easily disassembled and moved from track to track and there is nothing mechanical in the path of the dogs upon which they could be hurt. The structure of the lure support is preferably of light weight metal tubing, the bulbs in each group of five are staggered, or of different heights or shapes to avoid unnatural uniformity, and auditory signals are also used to simulate animal squeaks for additional authenticity of the lure. The system may be automatic and not require an operator by causing the control circuit to sense the position of the lead dog and maintain the "light" lure at a predetermined distance in advance of the lead dog.

DESCRIPTION OF A PREFERRED EMBODIMENT

Figure 1:
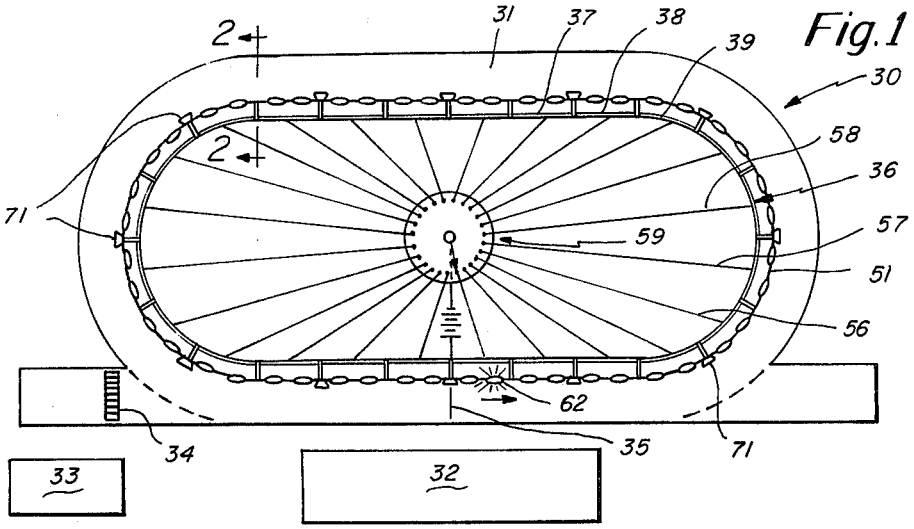
FIG. 1 is a top plan view of a dogtrack, including the grandstand, kennels, start boxes, finish line and the visual, non-mechanical lure of the invention.
Figure 3:
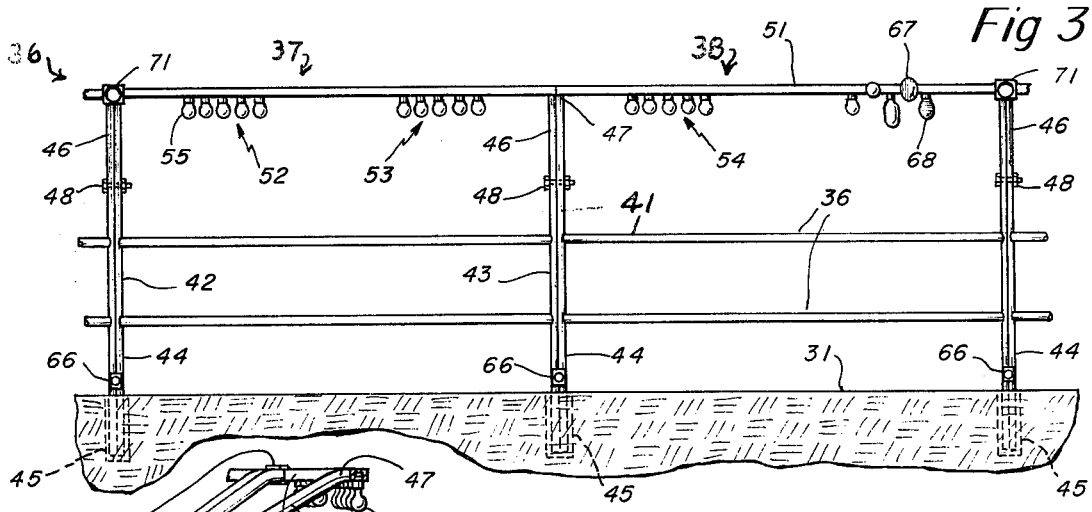
FIG. 3 is a fragmentary, side elevational view, similar to FIG. 2 and showing the lamp support means.
Figure 2:
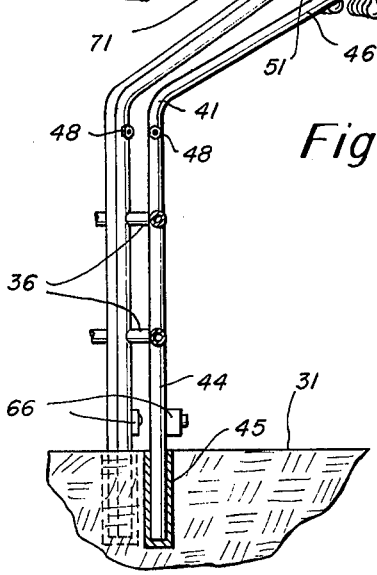
FIG. 2 is a fragmentary end elevational view, in section on line 2–2 of FIG. 1 and on an enlarged scale showing the portable, modular, lamp support means of the invention.
Figure 4:
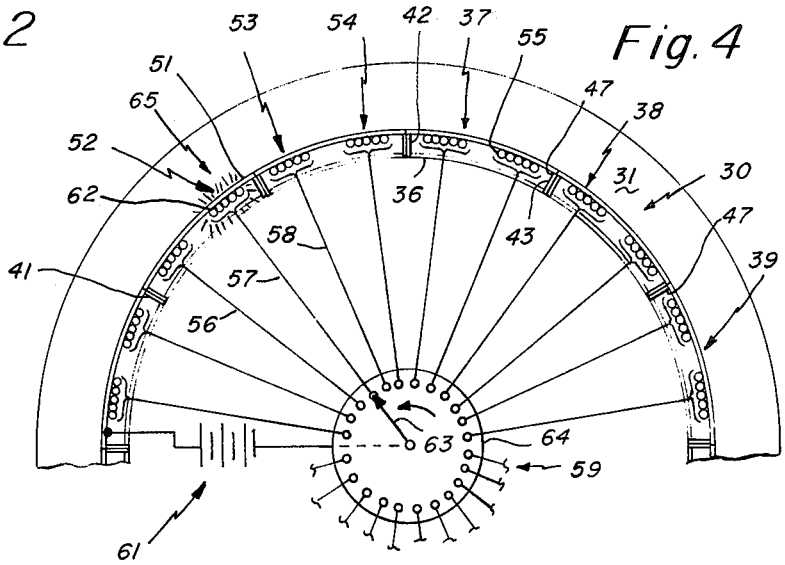
FIG. 4 is a fragmentary circuit diagram showing one system for individually and successively illuminating the groups of lamps of the invention.

In the drawing a race track 30 includes the closed loop track 31, grandstand 32, kennels or stables 33, start boxes 34 which constitute the start line, and a finish line 35. It will be understood that the track 31 could be straight rather than looped and that any type animal may be raced thereon but that the invention is directed to dogs of the greyhound breed. Such dogs are well known to be trained, and urged by instinct, to race after a moving object which they see, rather than to follow objects by scent. Conventionally, therefore, for many years each dog track has had a mechanical lure in the form of a rabbit, usually mounted on the end of a rod to extend out over the track and usually motivated by an electric motor carriage guided on a track. Rabbit lures are usually about the same length as a rabbit for example about a foot in length. When light has been used as a lure, as in the Meinecke and Shea patents above, a pictorial representation of a rabbit has been thought to be essential.

In this invention, there is no mechanical structure in the path of the greyhounds whether they run in the desired direction, inadvertently back track or enthusiastically overtake the lure in the excitement of race competition. To provide the usual inner periphery fence 36, extending around the inside of the track while also serving as a cantilevered support means, a plurality of identical, modular, sections such as 37, 38 and 39 are provided.

Each module such as 37 is formed of a skeletonized framework of light weight metal tubing 41, such as what is known as "Shelby" tubing, of about 1 inch in outside diameter, or any equivalent material. Each module such as 37 has a pair of upstanding posts 42 and 43 each having an upstanding, vertical lower portion 44, removably and slidably seated in a metal socket 45 and each having an upper integral portion 46 inclined outwardly over the track 31 at an angle of about 45° to cantilever the upper tips 47 at about 4 feet above the track and two feet from the inner periphery of the track. The juxtaposed modules 37, 38 and 39 are connected to each other by bolts and nuts as at 48 for ready erection and disassembly, although the two posts fitting in the same socket tends to maintain the modules in position.

A common electric conductor 51, which may be a cable, wire, rod, or tube of electrically conductive material such as metal is supported on the tips 47 of the posts 42 and 43 to extend continuously around the inner periphery of the track. Spaced at predetermined distances apart, along the conductor 51, are a series of groups 52, 53 and 54 of about five electric bulbs, or lamps, such as 55. For example, for each six foot long module 37, 38 or 39 there are two groups of about five bulbs such as 53 and 54, each group being about 1 foot long and the groups being spaced about 2 feet apart. Thus in the average track there will be about 1500 bulbs 55.

Each group of bulbs 52, 53 and 54 is connected by a radially extending conductor such as 56, 57 or 58 to a circuit control means 59, so that the source of current 61 is included in a closed circuit to energize the groups of bulbs individually and successively all around the track to appear as a moving, elongated strip of light 62 advancing around the track in the zone of vision of the greyhounds as they leave the starting boxes 34. A manual control arm 63 of a rotatable switch 64, may thus be turned by an operator to keep the simulated, rabbit lure means 65, in the form of the moving strip of light 62, always in the view of the dogs and slightly ahead of them to arouse their competitive racing instincts.

In an automatic mode of the invention a series of photo cells 66 mounted at spaced distances around the inner periphery fence 36 sense the arrival of the lead dog of the pack and each cell successively closes circuits to the groups of bulbs at the desired distance ahead of the pack to urge them forward with no danger of collision with any physical structure on the track. As shown in the drawing, while the lights 55 in each group may be substantially identical, it may be desirable to use lamps of different heights, diameters, configurations or colors such as at 67, 68, and mounted in staggered configuration within each group to lend variety and a closer simulation of a running or hopping rabbit.

In addition to the visual simulated lure means 65, an audio signal 71 is preferably mounted at spaced distances around the track, and energized by the adjacent bulb circuit to emit a squeak which tends to attract the attention of the greyhounds.

The start boxes 34 may also be released automatically by connection into the circuit means 59, when the group of bulbs in the line of vision of the dogs in the boxes are energized.

It will be noted that installing and removing the modules of the invention is simple, that the principal work or maintainance will be replacing an occasional bulb and that weather will not adversely affect the system.

I claim:

1. A race course for greyhounds of the type having a closed loop track with an inner periphery fence; an outer periphery fence; a start line, a finish line, light means spaced around the track to lure the greyhounds and electric control means for successively illuminating the light means, said race course characterized by:

said inner periphery fence including a plurality of spaced identical posts, each having an upstanding vertical lower portion; and integral upper portion inclined outwardly over the inner portion of said track and terminating in an upper tip;

a common electric conductor supported on the tips of said posts and extending continuously around the inner periphery of said track at a spaced distance thereabove;

and said light means comprising a series of groups of about five exposed light bulbs, each group being elongaged and spaced about two feet from adjacent groups, said series being mounted on said conductor whereby the individual and successive illumination of said spaced groups of light bulbs, from start line to finish line, above the level of the inner portion of said track, creates an easily visible, advancing, light beam lure for said greyhounds.

2. A race course as specified in claim 1 wherein said inner periphery fence is formed by a plurality of identical modules, each module including two of said posts and the posts of adjacent modules being juxtaposed;

and said fence includes a plurality of metal sockets embedded in the ground, each socket removably and slideably receiving the lower portions of a juxtaposed pair of said posts.

3. A race course as specified in claim 1 wherein said posts are dimensioned and angled to position the tips thereof, said conductor and said groups of exposed bulbs at about 4 feet above said track and about two feet outwardly from the inner periphery of the track.

4. A race course as specified in claim 1 wherein:

the exposed light bulbs in each said group are of different physical characteristics and mounted in staggered configuration within the group to simulate a running or hopping rabbit.

* * * * *